United States Patent [19]

McClure, Jr.

[11] Patent Number: 4,484,423

[45] Date of Patent: Nov. 27, 1984

[54] SEISMIC SHIELD

[75] Inventor: Cole R. McClure, Jr., Los Altos Hills, Calif.

[73] Assignee: Bechtel International Corporation, San Francisco, Calif.

[21] Appl. No.: 314,823

[22] Filed: Oct. 26, 1981

[51] Int. Cl.[3] ..... E04H 9/02; E02D 27/34

[52] U.S. Cl. ..... 52/167; 52/169.1; 52/742

[58] Field of Search ..... 52/167, 169.1, 169.5, 52/742, 2; 405/229, 267

[56] References Cited

U.S. PATENT DOCUMENTS

| | | | |
|---|---|---|---|
| 1,728,736 | 9/1929 | Shergold | 52/167 |
| 4,180,350 | 12/1979 | Watts | 405/267 |

FOREIGN PATENT DOCUMENTS

| | | | |
|---|---|---|---|
| 9971 | 1/1980 | Japan | 52/167 |
| 246077 | 1/1926 | United Kingdom | 52/167 |
| 626154 | 9/1978 | U.S.S.R. | 52/167 |

*Primary Examiner*—Alfred C. Perham

*Attorney, Agent, or Firm*—Townsend and Townsend

[57] ABSTRACT

A method and structure for partially isolating a building or other structure from the effects of an earthquake is disclosed. A generally vertical trench is formed spaced apart from the building and between the building and a known or suspected earthquake source. The trench is at least 100 meters deep and is filled with a material having a low shear modulus such as a fluid. The fill material inhibits the transmission of seismic waves, particularly S waves, through the material and further prevents the failure of the trench walls.

21 Claims, 6 Drawing Figures

SEISMIC SHIELD

BACKGROUND OF THE INVENTION

The effective protection of structures such as buildings, conventional and nuclear power plants, factories and the like against the effects of earthquakes remains an imperfectly attained goal. When an earthquake strikes, normally along an earthquake fault, seismic shock waves (meaning those caused by the earthquake) of three types emanate from the hypocenter of the earthquake, the initial point of rupture along the fault typically several kilometers or more below the surface. Of these seismic waves, shear waves, also called S (for secondary) waves, generally cause the greatest damage to structures. Compressional waves, also called P (for primary) waves, normally cause less damage. Surface waves, which are generated by the P and S waves when they reach the surface, travel along the ground surface and may also cause damage.

It is known that buildings can be protected from vibrations caused by blasting, traffic and the like by digging a trench a few feet deep between the blasting site and the building and filling the trench with a suitable material to thereby form a wall. U.S. Pat. No. 1,728,736 discloses the use of a subterranean wall placed adjacent the foundation of a house, or between a roadway and a sidewalk abutting the foundation, to protect the house from vibrations caused by vehicles on the roadway. The wall, which is about 6 feet deep, is made of a resilient material such as rubber or materials such as compressed cork, asbestos, bricks, or reinforced concrete blocks coated with rubber. These walls are relatively shallow barriers which may be effective against blasting and roadway vibrations because the wave lengths emanating therefrom are short, typically in the order of a few cm. The vibrations, having relatively short wavelengths and correspondingly short amplitudes, cannot merely bypass the barrier even though it is relatively shallow. However, such vibration isolation methods are ineffective protections against seismic waves because these waves have lengths of as much as ½ km or more. Therefore these relatively shallow trenches or walls merely move as a part of the earth's surface during an earthquake and provide no seismic protection whatsoever. In addition, the walls of the type disclosed in the referenced patent readily transmit S waves irrespective of the depth of the walls because of the substantial shear moduli of the materials from which they are made. Consequently, they cannot provide protection against seismic waves.

In the past, various attempts have been made to protect buildings against the effects of earthquakes by partially decoupling the foundation from the ground. U.S. Pat. No. 4,166,344 shows a building supported by slidable pads and held in place by a number of frangible links between the structure and the ground. When the horizontal motion of the ground exceeds a predetermined magnitude, the frangible links break allowing the ground to move beneath the building, thus reducing the amount of force transmitted from the ground to the building. U.S. Pat. No. 3,748,800 discloses an earthquake isolation foundation wherein the building is supported on a spring-centered building base in a water filled excavation. This structure is intended to reduce earthquake-induced accelerations, horizontally and vertically, on the building. Alternatively, the building base can be supported on sand, rather than on water, to provide a degree of isolation from horizontal movement of the ground.

However, none of these prior art methods can protect an existing building, such as a nuclear reactor and associated critical auxiliary structures, from the effects of an earthquake without extensive modification to at least the building's foundation. Depending upon the specific building and the character of the site, modification of the foundation according to the teaching of the prior art may be technically and/or economically unfeasible. Further, with the prior art protection methods the structural design of the building must be compatible with the protection method chosen. For some structures, such as nuclear power plants, design considerations may make the prior art methods inappropriate for incorporation into the design of the building.

Thus, what is lacking in the prior art is an effective system to protect both existing and future buildings against earthquake damage.

SUMMARY OF THE INVENTION

The present invention makes it possible to protect structures against damage from seismic waves. Generally speaking, this is accomplished by forming a seismic shield between the building and the source of potentially damaging earthquakes which impedes the seismic waves.

The seismic shield of the present invention is a relatively deep trench which is placed between the building and the potential earthquake source. It is shaped to shield the building against those earthquakes which, if they occur, are sufficiently close to the building that they may damage it. The trench is filled with a material generally incapable of transmitting seismic waves or, at least, which has a greatly reduced propensity to transmit the waves as compared with the surrounding ground. Ideally, the trench is gas filled, e.g., an open, air-filled trench, which would constitute an absolute barrier against the transmission of seismic waves. However, to constitute an effective seismic shield, the trench must be relatively deep, as discussed below, and its walls must be stable, that is, protected against caving, sluffing or air-slaking. To prevent such caving, sluffing or air-slaking, it is normally necessary to fill the trench with a material such as a liquid, gel or the like, which supports the trench walls and prevents their failure while preventing or greatly reducing the transmission across the trench of seismic waves in general and the S waves in particular.

Since the S waves are shear waves, fluids are most desirable as a trench fill. Other materials, such as gels and even certain low density, low shear modulus solids, can be used even though they do not entirely prevent the transmission of S waves across the trench as is the case with gases or liquids. Therefore, such materials presently constitute a second choice as a fill material.

The present invention is predicated upon the fact that when an earthquake begins at a depth which is usually unknown and may range, for example, from between 5 to 30 kilometers or more beneath the ground surface, it generates seismic waves which initially radiate from the hypocenter. To effectively protect a structure against damage from such an earthquake, the structure must be shielded from those waves radiating in its direction. The above-described trench forms that shield and, to be most effective, the shield should have a sufficient depth so that it both acts as an effective barrier against the relatively long-wave length surface waves and intercepts the refracted P and S waves. The former requires a minimum trench depth of about 100 meters while the latter might dictate trench depths of several kilometers depending upon the distance between the structure and the fault line, the distance between the trench and the structure and the expected maximum depth of the hypocenter. Such deep trench depths, however, are technologically difficult if not impossible to attain and, in any event, are at least presently economically unfeasible. For these reasons a trench depth of about 1000 meters is presently considered a maximum feasible depth.

The present invention utilizes a trench having a depth between 100 and 1000 meters and preferably filled with a fluid. Therefore, S waves striking the trench are almost completely reflected; they cannot cross the trench and thus they cannot reach the building. Depending on the particular fill material chosen, surface and P waves may be partially to completely reflected. Although a trench of this type will not completely isolate the building from the earthquake, the effects of the earthquake on the building will be greatly reduced.

Typically, the seismic forces acting on a building shielded against an earthquake in accordance with the present invention are expected to be reduced by 25–75%. As a result, the building can be designed so that it need withstand only moderate earthquakes, which both decreases its construction costs and enhances its overall safety. The latter aspect is of particular significance for nuclear power plants in which excessive seismic damage could lead to unacceptable consequences. To protect the power plant against damage from earthquakes in a conventional manner may so increase the cost of the power plant as to make it economically unfeasible. With the present invention, the trench can be constructed and filled with a suitable material at a relatively small cost so as to make it economically possible to erect a nuclear power plant in a seismically active area. Using the present invention the safety of the plant is not compromised and, more importantly, provides greater protection against damage by seismic waves.

Other features and advantages of the present invention will become apparent from the following description in which the preferred embodiment has been set forth in detail in conjunction with the accompanying drawings.

DETAILED DESCRIPTION OF THE PREFERRED EMBODIMENTS

Figure 1:
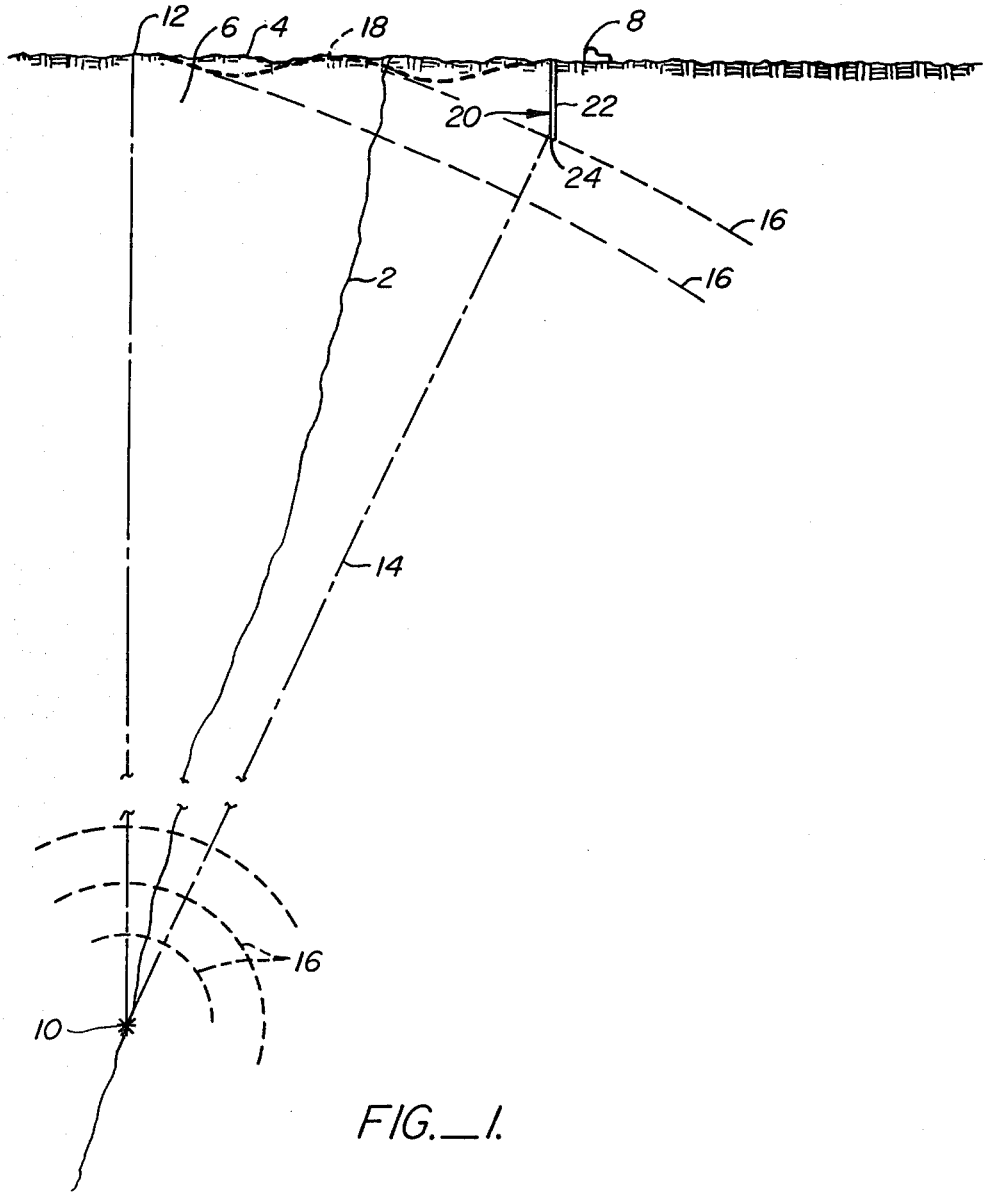
FIG. 1 is a sectional view through the earth illustrating the relationship between a fault, a seismic shield, and a building.

Referring first to FIG. 1, a fault 2 extending from the ground surface 4 downwardly through earth crust 6 is located some distance from a structure 8, such as a nuclear power plant, on the ground surface. It is assumed that an earthquake occurs at a hypocenter 10 at a location which is at some depth below the ground surface. The epicenter of the quake is that point 12 on the ground surface which is vertically above the hypocenter and in the illustrated example it is spaced some distance from the power plant.

When the earthquake strikes, seismic waves 16, namely P and S waves, radiate from the hypocenter in all directions including along radiant 14, a straight line which connects the hypocenter with the power plant in this idealized case. S and P waves striking the ground surface generate surface waves 18 which travel along the ground surface away from the epicenter at point 12 (located on the ground surface).

Figure 2:
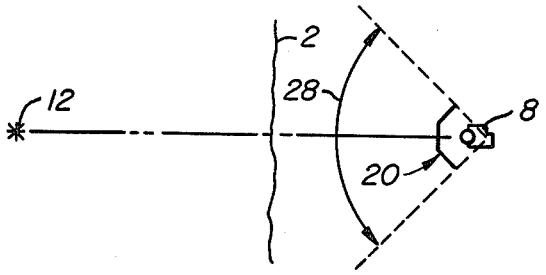
FIG. 2 is a plan view showing the seismic shield and building of FIG. 1 in relation to the fault.
Figure 5:
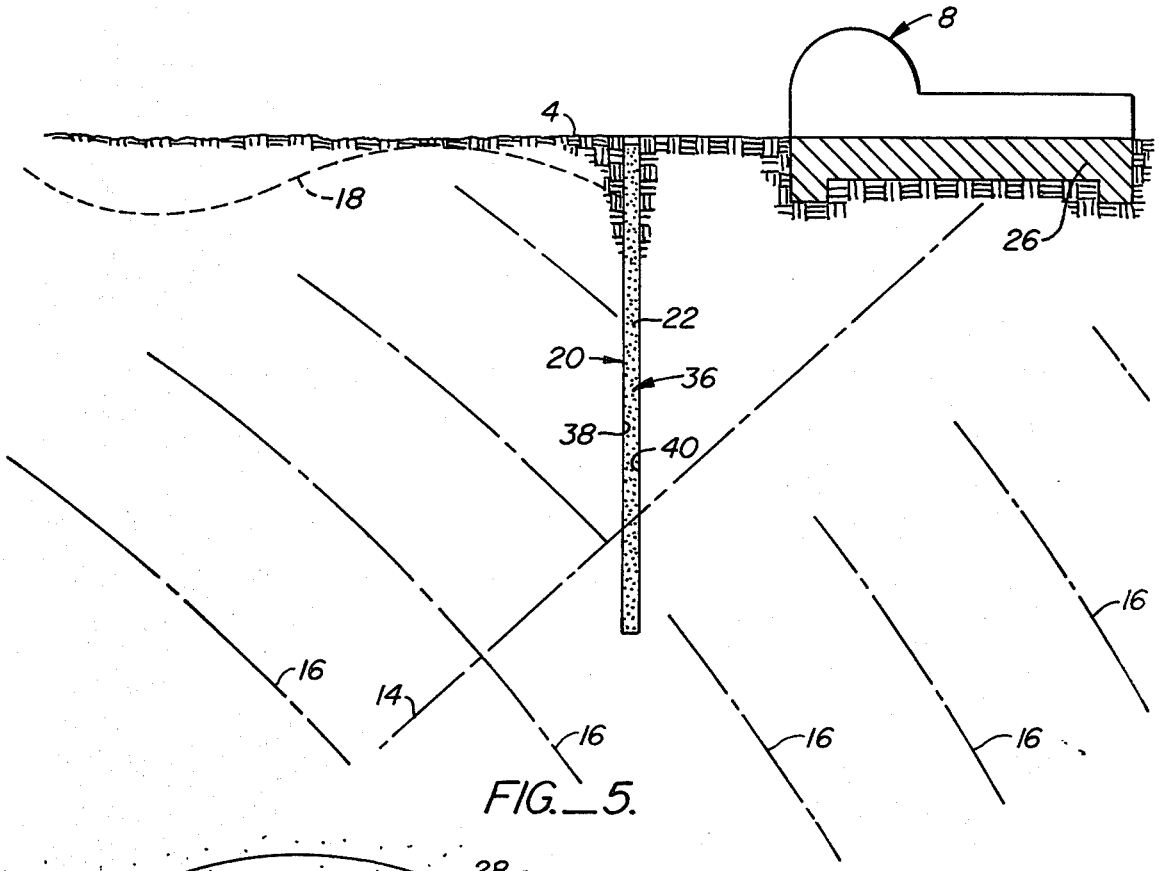
FIG. 5 is an enlarged cross-sectional view of a portion of FIG. 1.
Figure 3:
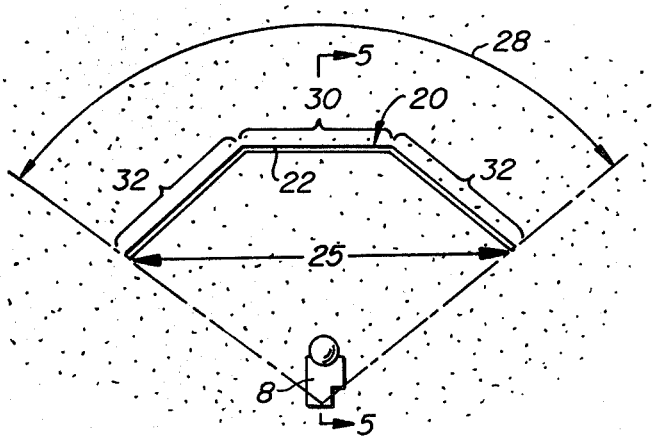
FIG. 3 is a schematic plan view showing the building shown in FIG. 1 protected by the seismic shield constructed according to the present invention.
Figure 4:
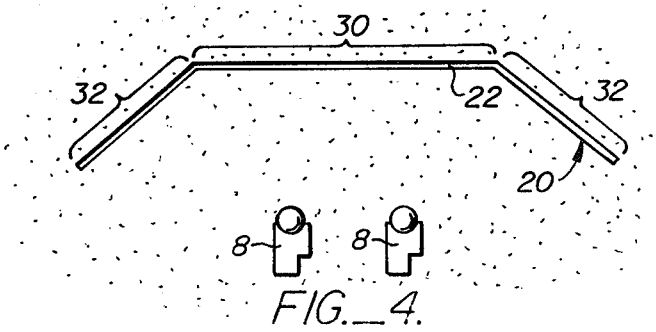
FIG. 4 illustrates an alternative arrangement in which two buildings are protected by a single seismic shield which is otherwise contructed as shown in FIG. 1.
Figure 6:
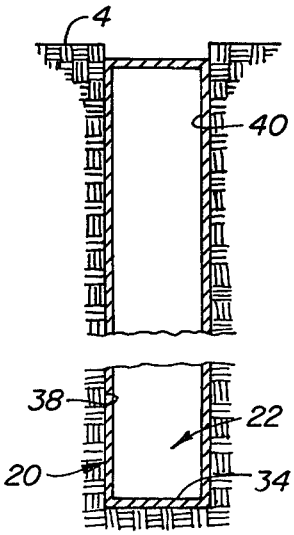
FIG. 6 is a fragmentary, enlarged cross-sectional view of a seismic shield constructed in accordance with another embodiment of the invention.

A seismic shield 20, see FIG. 2, constructed in accordance with the present invention is a "wall" of a material 36, see FIG. 5, which does not transmit seismic waves, especially the S waves, and which is disposed in a trench 22 located between the power plant 8 and the fault 2. The trench has a sufficient depth to help shield the power plant from such seismic waves. Since seismic waves emanating from an earthquake are complex combinations of waves in regard to both their character and their respective magnitude and travel directions, a seismic shield constructed in accordance with the present invention may provide significant protection for the building against the seismic waves.

Referring now also to FIGS. 3–6, the trench 22 is sufficiently spaced from building foundation 26, see FIG. 5, so that the trench will not affect the stability of the foundation in the ground. For a commercial power plant that distance may, for example, be in the range of about 30–60 m. The trench extends vertically downward from ground surface 4 and can have any desired width since the width as such does not significantly affect the effectiveness of the shield. With present construction machines and techniques a minimum trench width of about 1 m is required.

It is preferred to locate the trench as closely as possible to the building since that enhances its effectiveness. Its longitudinal (horizontal) extent 25 is primarily determined by the distance between the building and the fault where earthquakes are expected and the extent of likely earthquake sources. Extent 25 is chosen so that the shield will protect the building against damage from all earthquakes which may occur over the angle of the shield arc 28, see FIGS. 2 and 3, within which serious damage to the building, if unprotected, may occur. Conversely, earthquakes occurring along the fault outside the shield arc are sufficiently remote so that the seismic waves are attenuated by the ground and pose no real anticipated danger to the building. To maintain the shield as close as possible to the building, it is constructed in a smooth arc (not shown) or by forming distinct, angularly inclined trench sections such as center section 30 and side sections 32 shown in FIG. 3 which approximate an arc centered at the building.

Trench 22 is filled with a material 36, see FIG. 5, having a sufficiently low shear modulus so that substantially no S waves are transmitted across it. Under appropriate circumstances, that is when the trench walls are competent rock or another material such as concrete, the trench can remain open and the fill material can be air. Typically, however, the trench extends downwardly through sections of unstable ground and, to prevent failure of the walls, the trench is filled with a liquid, a gel, a slurry, a colloidal liquid, a foam, or a mixture thereof, all having the necessary low shear modulus. The specific material that is employed in a given instance is selected so that it is stable and permanent and will not be absorbed by the surrounding ground. To help prevent absorption, the trench walls may be suitably coated or impregnated, for example, with a layer of shotcrete or polyethylene. Under normal circumstances, the least expensive, most effective and most readily replenished fill material is water.

Solids can be used as a fill material provided they have a low shear modulus and a low density. One suitable material is plastic foam in continuous or granular form. Such materials are well suited to prevent the failure of the trench walls and their shear modulus is sufficiently low so that only a very small percentage of the S waves is transmitted, that is the low shear modulus of such materials transmits shear waves at very low speeds approaching zero with the effect that substantially no S waves are transmitted through it. However, solids are not as effective a barrier material as are gases (air), liquids or gels.

A still further alternative fill material are airbags 34 (see FIG. 6) which can be lowered into the trench and filled with air. When inflated the airbags are pressed against the trench walls 38, 40 and thereby protect the trench walls against failure. The air volume in the bag is an essentially absolute seismic barrier and prevents the transmission of all shear waves across the trench.

The effectiveness of the seismic shield 20 of the present invention during an earthquake should now be apparent. To briefly summarize it, when an earthquake strikes at hypocenter 10, P and S waves radiating along radiant 14 will strike the trench wall 36 near to the power plant 8. The fill material in the trench is a medium which does not transmit the S waves. Consequently, the "wall" of fill material in the trench shields the power plant from the waves generated by the earthquake. The top of the trench constitutes a similar barrier for the surface waves.

Those hypothetical seismic waves radiating from the hypocenter beneath the trench bottom 24, see FIG. 1, will miss the building so long as the trench intersects the radiant 14. Consequently, the only seismic waves to which the building might be subjected are those refracted (diverted from their original path) around and beneath the trench or reflected (bounced off a subterranean formation) at some point within the ground to the right of the building (as seen in FIG. 1).

When the seismic shield 20 of the present invention has a depth in the 100–1000 m range, it will provide effective protection against relatively shallow nearby earthquakes. Such earthquakes are the most dangerous because their points of rupture are closest to the building, and there is, therefore, only little attenuation of the seismic waves in the ground.

S and P waves radiate out from the hypocenter as shown in FIG. 1. Whether the S and P waves traveling along radiant 14 connecting hypocenter 10 and shield 20 will affect power plant 8 depends upon the depth of trench 22 and upon the distance between power plant 8 and shield 20. Therefore, protection from S and P waves can be enhanced by decreasing the distance between plant 8 and shield 20 and by increasing the depth of trench 22. However, the stability of the foundation 26 of power plant 8 requires that a certain separation between power plant 8 and shield 20 be maintained.

Although the best mode contemplated for carrying out the present invention has been herein shown and described, it will be apparent that modification and variation may be made without departing from what is regarded to be the subject of the invention as defined in the following claims. For example, parallel trenches, of the same or different depths, may be formed to create a pair of decoupling structures or the trench may be made to completely circumscribe the building if desired. Also, the protected structure may be built on ground 4 but partially or wholly buried within earth crust 6.

What is claimed is:

1. A method of protecting an earth supported structure from seismic waves emanating from a given location comprising the steps of:

forming a trench in the earth in the vicinity of the structure between the structure and the location to a depth of at least about 100 meters deep; and placing a fill material having a low shear modulus in the trench.

2. A method according to claim 1 wherein the step of placing comprises the step of substantially filling the trench with the fill material.

3. The method of claim 1 further comprising the step of:

lining the walls of the trench with a barrier material prior to said placing step.

4. The method of claim 1 wherein the step of forming includes the step of forming the trench to a depth of between 100 meters and 1000 meters.

5. The method of claim 1 wherein the step of forming includes the step of giving the trench a width of at least about ½ meter.

6. The method of claim 1 wherein said placing step includes the step of placing fill material chosen from the class of materials consisting of slurries, gels, liquids, colloidal liquids, and foams.

7. The method of claim 1 wherein said placing step includes the step of placing a solid fill material having a relatively light weight and low shear modulus.

8. The method of claim 1 wherein the placing step includes the step of filling the trench with a gas.

9. The method of claim 8 wherein the step of filling includes the step of pressurizing the gas.

10. In combination with a structure resting on the earth, a shield for attentuating an earthquake's effects on the structure comprising a generally vertically disposed subterranean wall made of material sustantially incapable of transmitting shear waves, said wall being supported by and conforming to the shape of a trench formed in the earth, said wall extending at least about 100 meters into the earth and being spaced apart from the building in a direction along which seismic surface waves are to be intercepted.

11. The shield of claim 10 wherein said wall is at least about ½ meter wide.

12. The apparatus of claim 10 wherein said fill material is chosen from a group of materials consisting of slurries, gels, liquids, colloidal liquids, and foams.

13. The apparatus of claim 10 wherein said wall is positioned between the structure and a seismically capable fault.

14. The shield of claim 10 wherein the material comprises a gas.

15. The shield of claim 14 wherein the gas is above atmospheric pressure and including flexible means disposed in and in contact with the trench holding the gas.

16. The combination of claim 10 and wherein the material supports the walls of the trench to prevent their failure.

17. The combination according to claim 16 wherein the material is in contact with the trench walls.

18. The combination according to claim 16 wherein the material is a fluid material.

19. The combination according to claim 18 including a relatively thin layer of a solid material interposed between the trench walls and the fluid material.

20. The combination according to claim 16 wherein the material is a solid material.

21. The combination of claim 10 wherein said wall extends about 100 to 1,000 meters into the ground.

* * * * *